US006833344B2

(12) United States Patent
Boutique et al.

(10) Patent No.: US 6,833,344 B2
(45) Date of Patent: Dec. 21, 2004

(54) FABRIC TREATMENT COMPOSITIONS COMPRISING DIFFERENT SILICONES, A PROCESS FOR PREPARING THEM AND A METHOD FOR USING THEM

(75) Inventors: Jean-Pol Boutique, Gembloux (BE); Patrick Firmin August Delplancke, Laarne (BE); Roland Wagner, Bonn (DE); Matthew David Butts, Rexford, NY (US); Sarah Elizabeth Genovese, Delmar, NY (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/700,809

(22) Filed: Nov. 4, 2003

(65) Prior Publication Data

US 2004/0092424 A1 May 13, 2004

Related U.S. Application Data

(60) Provisional application No. 60/423,485, filed on Nov. 4, 2002.

(51) Int. Cl.[7] ..... C11D 1/62; C11D 9/36

(52) U.S. Cl. ..... 510/330; 310/276; 310/308; 310/327; 310/466; 310/504; 310/515; 310/516

(58) Field of Search ..... 310/276, 308, 310/327, 466, 504, 515, 516, 330

(56) References Cited

U.S. PATENT DOCUMENTS

| | | | | |
|---|---|---|---|---|
| 4,364,837 | A | | 12/1982 | Pader |
| 4,371,517 | A | | 2/1983 | Claude et al. |
| 4,661,267 | A | | 4/1987 | Dekker et al. |
| 4,818,242 | A | | 4/1989 | Burmeister et al. |
| 4,960,845 | A | | 10/1990 | O'Lenick, Jr. et al. |
| 5,080,312 | A | | 1/1992 | Ebey |
| 5,085,857 | A | | 2/1992 | Reid et al. |
| 5,276,979 | A | | 1/1994 | Gordon, Sr. |
| 5,296,625 | A | | 3/1994 | O'Lenick, Jr. et al. |
| 5,580,494 | A | | 12/1996 | Sandhu et al. |
| 6,134,810 | A | | 10/2000 | Stockley |
| 6,136,215 | A | | 10/2000 | Evans et al. |
| 6,277,361 | B1 | * | 8/2001 | Murray ..... 424/70.12 |
| 6,355,234 | B1 | | 3/2002 | Birtwistle et al. |
| 6,451,747 | B1 | | 9/2002 | Decoster |
| 2002/0068689 | A1 | | 6/2002 | Fender et al. |
| 2002/0103094 | A1 | | 8/2002 | Masschelein et al. |

FOREIGN PATENT DOCUMENTS

| | | | |
|---|---|---|---|
| CA | 2320500 | * | 3/2001 |
| DE | 35 42 725 A | | 4/1989 |
| DE | 19853720 | * | 5/2000 |
| EP | 0 422 787 | | 4/1991 |
| EP | 0 468 721 A | | 1/1992 |
| EP | 0 530 974 A | | 3/1993 |
| EP | 0 811 051 B1 | | 12/1997 |
| EP | 0 989 226 | | 3/1999 |
| EP | 0 971 025 A | | 1/2000 |
| EP | 1 058 530 B1 | | 12/2000 |
| FR | 2 353 633 A | | 10/1980 |
| JP | 10211390 | | 8/1998 |
| WO | WO 99/44567 | | 9/1999 |
| WO | WO 00/24853 | | 5/2000 |
| WO | WO 00/24857 | | 5/2000 |
| WO | WO 00/70005 A1 | | 11/2000 |
| WO | WO 00/71806 A1 | | 11/2000 |
| WO | WO 01/25386 A1 | | 4/2001 |
| WO | WO 01/25387 A1 | | 4/2001 |
| WO | WO 02/10259 A1 | | 2/2002 |
| WO | WO 02/18528 | | 3/2002 |
| WO | WO 02/18528 A1 | | 3/2002 |
| WO | WO 02/36095 A2 | | 5/2002 |
| WO | WO 03/101411 A1 | | 12/2003 |

* cited by examiner

*Primary Examiner*—Charles Boyer
(74) *Attorney, Agent, or Firm*—Armina E. Matthews; Brahm J. Corstanje; Kim William Zerby

(57) ABSTRACT

The present invention relates to fabric treatment compositions comprising at least one or more cationic silicone polymers, comprising one or more polysiloxane units and one or more quaternary nitrogen moieties, and an nitrogen-free silicone polymer wherein the ratio by weight of the cationic silicone polymer to the nitrogen-free silicone polymer is from 10:1 to 0.01:1, preferably from 5:1 to 0.05:1, and more preferably from 1:1 to 0.1:1. A process for preparing such compositions, a method of treating substrates and the use of such compositions are also described.

15 Claims, No Drawings

FABRIC TREATMENT COMPOSITIONS COMPRISING DIFFERENT SILICONES, A PROCESS FOR PREPARING THEM AND A METHOD FOR USING THEM

CROSS REFERENCE TO RELATED APPLICATION

This application claims the benefit of U.S. Provisional Application No. 60/423,485, filed on Nov. 4, 2002.

FIELD OF THE INVENTION

This invention relates to fabric treatment compositions. The invention also relates to methods for treating fabrics in fabric treatment applications with such fabric treatment compositions to thereby provide improved fabric care. The invention further relates to a process for preparing such fabric treatment compositions.

BACKGROUND OF THE INVENTION

When consumers launder fabrics, they desire not only excellence in cleaning, they also seek superior to impart superior fabric care benefits. Such care can be exemplified by one or more of reduction of wrinkles benefits; removal of wrinkles benefits; prevention of wrinkles benefits; fabric softness benefits; fabric feel benefits; garment shape retention benefits; garment shape recovery benefits; elasticity benefits; ease of ironing benefits; perfume benefits; color care benefits; or any combination thereof.

Compositions which can provide fabric care benefits during laundering operations are known, for example in form of rinse-added fabric softening compositions. Compositions which can provide both cleaning and fabric care benefits, e.g., fabric softening benefits, at the same time, are also known, for example in the form of "2-in-1" compositions and/or "softening through the wash" compositions. WO 00/24 853 and WO 00/24 857 (both to Unilever, published May 4, 2000) describes laundry detergent compositions comprising a wrinkle reduction agent selected from among others from aminopolydimethyl-siloxane polyalkyleneoxide copolymers. In WO 00/71806 (Unilever, published Nov. 30, 2000) fabric softening compositions comprising a cationic quaternary ammonium fabric softening active and an emulsified silicone with a specific viscosity are disclosed. EP 989 226 (Dow Corning, published Sep. 24, 1999) claims a water-based fiber treatment agent comprising 100 parts of silicone oil, 5 to 200 parts of silicone rubber with an average particle size between 0.1 $\mu$m to 500 $\mu$m and water. U.S. Pat. No. 6,136,215 (Dow Corning, granted Oct. 24, 2000) describes a fiber treatment composition comprising a combination of an amine-, poly-functional siloxane having a specific formula with a polyol-, amide-functional siloxane having a specific formula and an active ingredient comprising an amine-, polyol, amide-functional siloxane copolymer of a specific formula. EP 1 199 350 (Goldschmidt, published on Apr. 24, 2002) discloses the use of quaternary polysiloxanes in detergent formulations claiming a fabric softening benefit. WO 02/18 528 (Procter & Gamble, published on Mar. 7, 2002) describes fabric care and perfume compositions for improved fabric care, the composition comprises a cationic silicone polymer comprising one or more polysiloxane units and one or more quaternary nitrogen moieties and one or more laundry adjunct materials.

In spite of the advances in the art, there remains a need for improved fabric care. In particular, there remain important unsolved problems with respect to selecting cationic silicones and other fabric care ingredients so that the combination of both provides uncompromising levels of fabric care. Furthermore, when the composition is a laundry detergent composition, it remains particularly difficult to combine anionic surfactants and selected cationic silicones in such a way as to secure superior fabric care at the same time as outstanding cleaning and formulation stability or flexibility.

Accordingly, objects of the present invention include to solve the hereinabove mentioned technical problems and to provide compositions and methods having specifically selected cationic silicones, silicones and optionally other adjuncts that secure superior fabric care.

An essential component of the present invention is a fabric treatment composition which comprises as one essential element at least one specific cationic silicone polymer. Another essential component of the compositions of the present invention is a nitrogen-free silicone polymer. The combination of the specific cationic silicone polymer with the specific nitrogen-free silicones polymer provides superior fabric care in home laundering.

The present invention imparts superior fabric care and/or garment care as exemplified above. Moreover the invention has other advantages, depending on the precise embodiment, which include superior formulation flexibility and/or formulation stability of the home laundry compositions provided.

It has surprisingly been found that, given proper attention both to the selection of the cationic silicone polymer and to the nitrogen-free silicone polymer, unexpectedly good fabric care benefits and/or consumer acceptance of the home laundry product are obtained. Moreover, superior fabric care or garment care benefits in home laundering as discovered in the present invention unexpectedly include benefits when the products herein are used in different modes, such as treatment before washing in an automatic washing machine (pretreatment benefits), through-the wash benefits, and post-treatment benefits, including benefits secured when the inventive products are used in the rinse or in fabric or garment spin-out or drying in, or outside an appliance. Additionally discovered are regimen benefits, i.e., benefits of converting from use of a product system comprising conventional detergents to a product system comprising use of the present inventive compositions and compositions formulated specifically for use therewith. In particular, it has been found that the combination of a specific cationic silicone polymer and a nitrogen-free silicone polymer provides synergistic effects for fabric care: the combination of both ingredients provide larger fabric care benefits at a given level such as softness compared to softness delivered from the only one of the two components when used on its own at combined levels. It has also been found that the combination of a specific cationic silicone polymer and a nitrogen-free silicone polymer demonstrates a higher robustness to soils and also to anionic surfactants, which may be carried over within the fabrics from the foregoing wash cycle in which a detergent composition comprising an anionic surfactant was used.

SUMMARY OF THE INVENTION

The present invention relates to a fabric treatment composition comprising at least one or more cationic silicone polymers, comprising one or more polysiloxane units and one or more quaternary nitrogen moieties, and one or more nitrogen-free silicone polymers characterized in that the ratio by weight of the cationic silicone polymers to the nitrogen-free silicone polymers is from 10:1 to 0.01:1, preferably from 5:1 to 0.05:1, and more preferably from 1:1 to 0.1:1.

The present invention further describes a method for treating a substrate. This method includes contacting the substrate with the fabric treatment composition of the present invention such that the substrate is treated.

The present invention also discloses a process for preparing the fabric treatment composition of the present invention or the liquid laundry detergent composition of the present invention comprising the step of a) premixing the nitrogen-free silicone polymer with the cationic silicone polymer, optionally in the presence of one or more ingredients selected from the group consisting of a solvent system, one or more surfactants, one or more silicone-containing surfactants, one or more low-viscosity silicone-containing solvents and mixtures thereof; b) premixing all other ingredients; and c) combining said two premixes a) and b).

The invention further includes the use of the fabric treatment composition of the present invention to impart fabric care benefits on a fabric substrate.

DETAILED DESCRIPTION OF THE INVENTION

A, Cationic Silicone Polymer

The cationic silicone polymer selected for use in the present invention compositions comprises one or more polysiloxane units, preferably polydimethylsiloxane units of formula $—\{(CH_3)_2SiO\}_c—$ having a degree of polymerization, c, of from 1 to 1000, preferably of from 20 to 500, more preferably of from 50 to 300, most preferably from 100 to 200, and organosilicone-free units comprising at least one diquaternary unit. In a preferred embodiment of the present invention, the selected cationic silicone polymer has from 0.05 to 1.0 mole fraction, more preferably from 0.2 to 0.95 mole fraction, most preferably 0.5 to 0.9 mole fraction of the organosilicone-free units selected from cationic divalent organic moieties. The cationic divalent organic moiety is preferably selected from N,N,N',N'-tetramethyl-1,6-hexanediammonium units.

The selected cationic silicone polymer can also contain from 0 to 0.95 mole fraction, preferably from 0.001 to 0.5 mole fraction, more preferably from 0.05 to 0.2 mole fraction of the total of organosilicone-free units, polyalkyleneoxide amines of the following formula:

$$[—Y—O(—C_aH_{2a}O)_b—Y—]$$

wherein Y is a divalent organic group comprising a secondary or tertiary amine; a is from 2 to 4, and b is from 0 to 100. The polyalkyleneoxide blocks may be made up of ethylene oxide (a=2), propylene oxide (a=3), butylene oxide (a=4) and mixtures thereof, in a random or block fashion.

Such polyalkyleneoxide amine-containing units can be obtained by introducing in the silicone polymer structure, compounds such as those sold under the tradename Jeffamine® from Huntsman Corporation. A preferred Jeffamine is Jeffamine ED-2003.

The selected cationic silicone polymer can also contain from 0, preferably from 0.001 to 0.2 mole fraction, of the total of organosilicone-free units, of $—NR_3+$ wherein R is alkyl, hydroxyalkyl or phenyl. These units can be thought of as end-caps.

Moreover the selected cationic silicone polymer generally contains anions, selected from inorganic and organic anions, more preferably selected from saturated and unsaturated $C_1$–$C_{20}$ carboxylates and mixtures thereof, to balance the charge of the quaternary moieties, thus the cationic silicone polymer also comprises such anions in a quaternary charge-balancing proportion.

Conceptually, the selected cationic silicone polymers herein can helpfully be thought of as non-crosslinked or "linear" block copolymers including non-fabric-substantive but surface energy modifying "loops" made up of the polysiloxane units, and fabric-substantive "hooks". One preferred class of the selected cationic polymers (illustrated by Structure 1 hereinafter) can be thought of as comprising a single loop and two hooks; another, very highly preferred, comprises two or more, preferably three or more "loops" and two or more, preferably three or more "hooks" (illustrated by Structures 2a and 2b hereinafter), and yet another (illustrated by Structure 3 hereinafter) comprises two "loops" pendant from a single "hook".

Of particular interest in the present selection of cationic silicone polymers is that the "hooks" contain no silicone and that each "hook" comprises at least two quaternary nitrogen atoms.

Also of interest in the present selection of preferred cationic silicone polymers is that the quaternary nitrogen is preferentially located in the "backbone" of the "linear" polymer, in contradistinction from alternate and less preferred structures in which the quaternary nitrogen is incorporated into a moiety or moieties which form a "pendant" or "dangling" structure off the "backbone".

The structures are completed by terminal moieties which can be noncharged or charged. Moreover a certain proportion of nonquaternary silicone-free moieties can be present, for example the moiety $[—Y—O(—C_aH_{2a}O)_b—Y—]$ as described hereinabove.

Of course the conceptual model presented is not intended to be limiting of other moieties, for example connector moieties, which can be present in the selected cationic silicone polymers provided that they do not substantially disrupt the intended function as fabric benefit agents.

In more detail, the cationic silicone polymers herein have one or more polysiloxane units and one or more quaternary nitrogen moieties, including polymers wherein the cationic silicone polymer has the formula: (Structure 1)

STRUCTURE 1

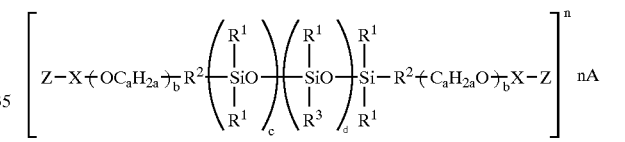

wherein:

$R^1$ is independently selected from the group consisting of: $C_{1-22}$ alkyl, $C_{2-22}$ alkenyl, $C_{6-22}$ alkylaryl, aryl, cycloalkyl and mixtures thereof;

$R^2$ is independently selected from the group consisting of: divalent organic moieties that may contain one or more oxygen atoms (such moieties preferably consist essentially of C and H or of C, H and O);

X is independently selected from the group consisting of ring-opened epoxides;

$R^3$ is independently selected from polyether groups having the formula:

$$—M^1(C_aH_{2a}O)_b—M^2$$

wherein $M^1$ is a divalent hydrocarbon residue, $M^2$ is H, $C_{1-22}$ alkyl, $C_{2-22}$ alkenyl, $C_{6-22}$ alkylaryl, aryl; cycloalkyl, $C_{1-22}$ hydroxyalkyl, polyalkyleneoxide or (poly)alkoxy alkyl;

Z is independently selected from the group consisting of monovalent organic moieties comprising at least one quaternized nitrogen atom;

a is from 2 to 4; b is from 0 to 100; c is from 1 to 1000, preferably greater than 20, more preferably greater than 50, preferably less than 500, more preferably less than 300, most preferably from 100 to 200; d is from 0 to 100; n is the number of positive charges associated with the cationic silicone polymer, which is greater than or equal to 2; and A is a monovalent anion.

In a preferred embodiment of the Structure 1 cationic silicone polymers, Z is independently selected from the group consisting of:

(i)

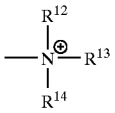

(ii)

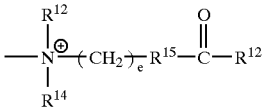

(iii)

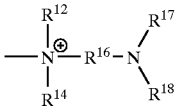

(iv)

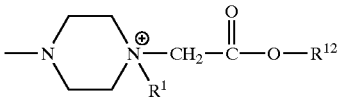

(v)

monovalent aromatic or aliphatic heterocyclic group, substituted or unsubstituted, containing at least one quatemized nitrogen atom;

wherein:

$R^{12}$, $R^{13}$, $R^{14}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl, and mixtures thereof;

$R^{15}$ is —O— or $NR^{19}$;

$R^{16}$ is a divalent hydrocarbon residue;

$R^{17}$, $R^{18}$, $R^{19}$ are the same or different, and are selected from the group consisting of: H, $C_{1-22}$ alkyl, $C_{2-22}$ alkenyl, $C_{6-22}$ alkylaryl, aryl, cycloalkyl, $C_{2-22}$ hydroxyalkyl; polyalkyleneoxide, (poly)alkoxy alkyl and mixtures thereof; and e is from 1 to 6.

In a highly preferred embodiment, the cationic silicone polymers herein have one or more polysiloxane units and one or more quaternary nitrogen moieties, including polymers wherein the cationic silicone polymer has the formula: (Structure 2a)

STRUCTURE 2a: Cationic silicone polymer composed of alternating units of:

(i) a polysiloxane of the following formula

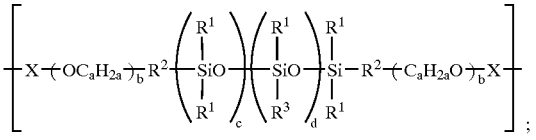

and (ii) a divalent organic moiety comprising at least two quaternized nitrogen atoms.

Note that Structure 2a comprises the alternating combination of both the polysiloxane of the depicted formula and the divalent organic moiety, and that the divalent organic moiety is organosilicone-free corresponding to a preferred "hook" in the above description.

In this preferred cationic silicone polymer, $R^1$ is independently selected from the group consisting of: $C_{1-22}$ alkyl, $C_{2-22}$ alkenyl, $C_{6-22}$ alkylaryl, aryl, cycloalkyl and mixtures thereof;

$R^2$ is independently selected from the group consisting of: divalent organic moieties that may contain one or more oxygen atoms;

X is independently selected from the group consisting of ring-opened epoxides;

$R^3$ is independently selected from polyether groups having the formula:

$$—M^1(C_aH_{2a}O)_b—M^2$$

wherein $M^1$ is a divalent hydrocarbon residue; $M^2$ is H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide or (poly)alkoxy alkyl;

a is from 2 to 4; b is from 0 to 100; c is from 1 to 1000, preferably greater than 20, more preferably greater than 50, preferably less than 500, more preferably less than 300, most preferably from 100 to 200; and d is from 0 to 100.

In an even more highly preferred embodiment of the Structure 2a cationic silicone polymer, the cationic silicone polymer has the formula Structure 2b wherein the polysiloxane (i) of the formula described above as Structure 2a is present with (ii) a cationic divalent organic moiety selected from the group consisting of:

(a)

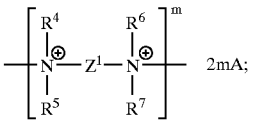

(b)

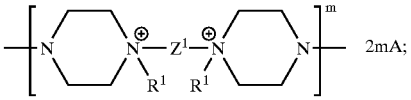

(c)

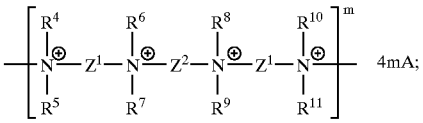

(d)

a divalent aromatic or aliphatic heterocyclic group, substituted or unsubstituted, containing at least one quatemized nitrogent atom; and (iii) optionally, a polyalkyleneoxide amine of formula:

$$[—Y—O(—C_aH_{2a}O)_b—Y—]$$

Y is a divalent organic group comprising a secondary or tertiary amine, preferably a $C_1$ to $C_8$ alkylenamine residue; a is from 2 to 4; b is from 0 to 100; the polyalkyleneoxide blocks may be made up of ethylene oxide (a=2), propylene oxide (a=3), butylene oxide (a=4) and mixtures thereof, in a random or block fashion; and (iv) optionally, a cationic monovalent organic moiety, to be used as an end-group, selected from the group consisting of:

(i)

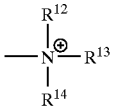

(ii)

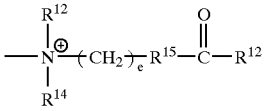

(iii)

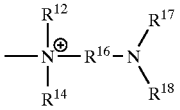

(iv)

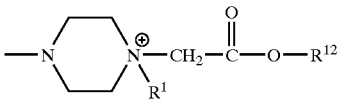

(v)

monovalent aromatic or aliphatic heterocyclic group, substituted or unsubstituted, containing at least one quatemized nitrogen atom;

from 0.5 to 0.9 mole fraction; the polyalkyleneoxide amine (iii) can be present of from 0.0 to 0.95 mole fraction, preferably of from 0.001 to 0.5, and more preferably of from 0.05 to 0.2 mole fraction; if present, the cationic monovalent organic moiety (iv) is present of from 0 to 0.2 mole fraction, preferably of from 0.001 to 0.2 mole fraction;

e is from 1 to 6; m is the number of positive charges associated with the cationic divalent organic moiety, which is greater than or equal to 2; and A is an anion.

Note that Structure 2b comprises the alternating combination of both the polysiloxane of the depicted formula and the divalent organic moiety, and that the divalent organic moiety is organosilicone-free corresponding to a preferred "hook" in the above general description. Structure 2b moreover includes embodiments in which the optional polyalkyleneoxy and/or end group moieties are either present or absent.

In yet another embodiment, the cationic silicone polymers herein have one or more polysiloxane units and one or more quaternary nitrogen moieties, and including polymers wherein the cationic silicone polymer has the formula: (Structure 3)

STRUCTURE 3

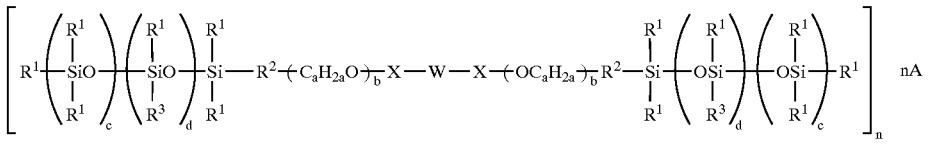

wherein:

$R^4$, $R^5$, $R^6$, $R^7$, $R^8$, $R^9$, $R^{10}$, $R^{11}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl and mixtures thereof; or in which $R^4$ and $R^6$, or $R^5$ and $R^7$, or $R^8$ and $R^{10}$, or $R^9$ and $R^{11}$ may be components of a bridging alkylene group;

$R^{12}$, $R^{13}$, $R^{14}$ are the same or different, and are selected from the group consisting of: $C_{1-22}$ alkyl; $C_{2-22}$ alkenyl; $C_{6-22}$ alkylaryl; $C_{1-22}$ hydroxyalkyl; polyalkyleneoxide; (poly)alkoxy alkyl groups and mixtures thereof; and $R^{15}$ is —O— or $NR^{19}$;

$R^{16}$ and $M^1$ are the same or different divalent hydrocarbon residues;

$R^{17}$, $R^{18}$, $R^{19}$ are the same or different, and are selected from the group consisting of: H, $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide, (poly)alkoxy alkyl, and mixtures thereof; and $Z^1$ and $Z^2$ are the same or different divalent hydrocarbon groups with at least 2 carbon atoms, optionally containing a hydroxy group, and which may be interrupted by one or several ether, ester or amide groups;

wherein, expressed as fractions on the total moles of the organosilicone-free moieties, the cationic divalent organic moiety (ii) is preferably present at of from 0.05 to 1.0 mole fraction, more preferably of from 0.2 to 0.95 mole fraction, and most preferably of wherein:

$R^1$ is independently selected from the group consisting of: $C_{1-22}$ alkyl; $C_{2-22}$ alkenyl; $C_{6-22}$ alkylaryl; aryl; cycloalkyl and mixtures thereof;

$R^2$ is independently selected from the group consisting of: divalent organic moieties that may contain one or more oxygen atoms;

X is independently selected from the group consisting of ring-opened epoxides;

$R^3$ is independently selected from polyether groups having the formula:

$$—M^1(C_aH_{2a}O)_b—M^{27}$$

wherein $M^1$ is a divalent hydrocarbon residue, $M^2$ is H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide or (poly)alkoxy alkyl;

X is independently selected from the group consisting of ring-opened epoxides;

W is independently selected from the group consisting of divalent organic moieties comprising at least one quaternized nitrogen atom a is from 2 to 4; b is from 0 to 100; c is from 1 to 1000, preferably greater than 20, more preferably greater than 50, preferably less than 500, more preferably less than 300, most preferably from 100 to 200; d is from 0 to 100; n is the number of positive charges associated with the cationic silicone polymer, which is greater than or equal to 1; and A is a monovalent anion, in other words, a suitable couterion.

In preferred cationic silicone polymers of Structure 3, W is selected from the group consisting of:

(a)

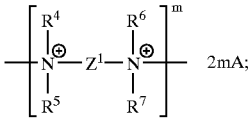

2mA;

(b)

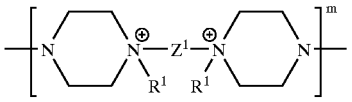

2mA;

(c)

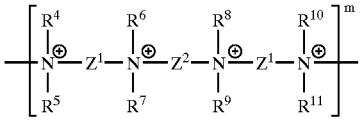

4mA;

(d)

a divalent aromatic or aliphatic heterocyclic group, substituted or unsubstituted, containing at least one quatemized nitrogent atom; and $R^4$, $R^5$, $R^6$, $R^7$, $R^8$, $R^9$, $R^{10}$, $R^{11}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl, and mixtures thereof; or in which $R^4$ and $R^6$, or $R^5$ and $R^7$, or $R^8$ and $R^{10}$, or $R^9$ and $R^{11}$ may be components of a bridging alkylene group; and $Z^1$ and $Z^2$ are the same or different divalent hydrocarbon groups with at least 2 carbon atoms, optionally containing a hydroxy group, and which may be interrupted by one or several ether, ester or amide groups.

Reference is made to the following patents and patent applications which do also disclose cationic silicone polymers suitable for use in the present invention: WO 02/06 403; WO 02/18 528, EP 1 199 350; DE OS 100 36 533; WO 00/24 853; WO 02/10 259; WO 02/10 257 and WO 02/10 256.

Synthesis Example—When not otherwise known or available in commerce, the cationic silicone polymers herein can be prepared by conventional techniques as disclosed in WO 02/18 528.

B, Nitrogen-free Silicone Polymer

The nitrogen-free silicone polymer selected for use in the compositions of the present inventions includes nonionic, anionic, zwitterionic and amphoteric nitrogen-free silicone polymers.

Preferably, the nitrogen-free silicone polymer is selected from nonionic nitrogen-free silicone polymers having the formulae (I) to (III):

(I)

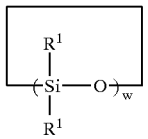

;

$$R^2—(R^1)_2SiO—[(R^1)_2SiO]_a—[(R^1)(R^2)SiO]_b—Si(R^1)_2R^2$$

(III)

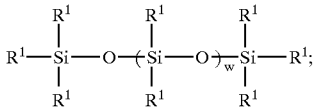

and mixtures thereof, wherein each $R^1$ is independently selected from the group consisting of linear, branched or cyclic alkyl groups having from 1 to 20 carbon atoms; linear, branched or cyclic alkenyl groups having from 2 to 20 carbon atoms; aryl groups having from 6 to 20 carbon atoms; alkylaryl groups having from 7 to 20 carbon atoms; arylalkyl and arylalkenyl groups having from 7 to 20 carbon atoms and mixtures thereof, each $R^2$ is independently selected from the group consisting of linear, branched or cyclic alkyl groups having from 1 to 20 carbon atoms; linear, branched or cyclic alkenyl groups having from 2 to 20 carbon atoms; aryl groups having from 6 to 20 carbon atoms; alkylaryl groups having from 7 to 20 carbon atoms; arylalkyl; arylalkenyl groups having from 7 to 20 carbon atoms and from a poly(ethyleneoxide/propyleneoxide) copolymer group having the general formula (IV):

$$—(CH_2)_nO(C_2H_4O)_c(C_3H_6O)_dR^3 \quad (IV)$$

with at least one $R^2$ being a poly(ethyleneoxy/propyleneoxy) copolymer group, and each $R^3$ is independently selected from the group consisting of hydrogen, an alkyl having 1 to 4 carbon atoms, and an acetyl group, wherein the index w has the value as such that the viscosity of the nitrogen-free silicone polymer of formulae (I) and (III) is between $2–10^{-6}$ $m^2/s$ (2 centistokes at 20° C. at 20° C.) and 50 $m^2/s$ (50,000,000 centistokes at 20° C. at 20° C.); wherein a is from 1 to 50; b is from 1 to 50; n is 1 to 50; total c (for all polyalkyleneoxy side groups) has a value of from 1 to 100; total d is from 0 to 14; total c+d has a value of from 5 to 150.

More preferably, the nitrogen-free silicone polymer is selected from linear nonionic nitrogen-free silicone polymers having the formulae (II) to (III) as above, wherein $R^1$ is selected from the group consisting of methyl, phenyl, and phenylalkyl; wherein $R^2$ is selected from the group consisting of methyl, phenyl, phenylalkyl and from the group having the general formula (IV), defined as above; wherein $R^3$ is defined as above and wherein the index w has the value as such that the viscosity of the nitrogen-free silicone polymer of formula (III) is between 0.01 $m^2/s$ (10,000 centistokes at 20° C.) and 0.8 $m^2/s$ (800,000 centistokes at 20° C.); a is from 1 to 30, b is from 1 to 30, n is from 3 to 5, total c is from 6 to 100, total d is from 0 to 3, and total c+d is from 7 to 100.

Most preferably, the nitrogen-free silicone polymer is selected from linear nonionic nitrogen-free silicone polymers having the formula (III) as above, wherein $R^1$ is methyl and wherein the index w has the value as such that the viscosity of the nitrogen-free silicone polymer of formula (III) is between 0.06 $m^2/s$ (60,000 centistokes at 20° C.) and 0.7 $m^2/s$ (700,000 centistokes at 20° C.) and more preferably between 0.1 $m^2/s$ (100,000 centistokes at 20° C.) and 0.48 $m^2/s$ (480,000 centistokes at 20° C.), and mixtures thereof.

Nonlimiting examples of nitrogen-free silicone polymers of formula (II) are the Silwet® compounds which are available from OSI Specialties Inc., a Division of Witco, Danbury, Conn. For the preparation of the compositions of the present invention, it may be desirable to include nitrogen-free silicone polymers which belong to the group of the Silwet® compounds. Nonlimiting examples of nitrogen-free silicone polymers of formula (I) and (III) are the Silicone 200 fluid series from Dow Corning.

C, Ratio by Weight and Percentage Contents of the Silicone Components

The ratio by weight of the cationic silicone polymer to the nitrogen-free silicone polymer is between from 10:1 to 0.01:1, preferably from 5:1 to 0.05:1, and more preferably from 1:1 to 0.1:1.

The compositions of the present invention comprise from 0.001% to 90%, preferably from 0.01% to 50%, more preferably from 0.1% to 20%, and most preferably from 0.2% to 5% by weight of composition of the cationic silicone polymer and from 0.001% to 90%, preferably from 0.01% to 50%, more preferably from 0.1% to 10%, and most preferably from 0.5% to 5% by weight of the composition of the nitrogen-free silicone polymer, provided that the requirement of the specific ratio by weight of these two components as set forth above is fulfilled.

Laundry Adjunct Materials (a) Stabilizer

Compositions of the present invention may optionally comprise and preferably do comprise a stabilizer. Suitable levels of this component, if present, are in the range from 0.1% to 20%, preferably from 0.15% to 10%, and even more preferably from 0.2% to 3% by weight of the composition. The stabilizer serves to stabilize the silicone polymer in the inventive compositions and to prevent it from coagulating and/or creaming. This is especially important when the inventive compositions have fluid form, as in the case of liquid or gel-form laundry detergents for heavy-duty or fine fabric wash use, and liquid or gel-form fabric treatments other than laundry detergents.

Stabilizers suitable for use herein can be selected from thickening stabilizers. These include gums and other similar polysaccharides, for example gellan gum, carrageenan gum, and other known types of thickeners and rheological additives other than highly polyanionic types; thus conventional clays are not included.

More preferably the stabilizer is a crystalline, hydroxyl-containing stabilizing agent, more preferably still, a trihydroxystearin, hydrogenated oil or a derivative thereof.

Without intending to be limited by theory, the crystalline, hydroxyl-containing stabilizing agent is a nonlimiting example of a "thread-like structuring system." "Thread-like Structuring System" as used herein means a system comprising one or more agents that are capable of providing a chemical network that reduces the tendency of materials with which they are combined to coalesce and/or phase split. Examples of the one or more agents include crystalline, hydroxyl-containing stabilizing agents and/or hydrogenated jojoba. Surfactants are not included within the definition of the thread-like structuring system. Without wishing to be bound by theory, it is believed that the thread-like structuring system forms a fibrous or entangled threadlike network in-situ on cooling of the matrix. The thread-like structuring system has an average aspect ratio of from 1.5:1, preferably from at least 10:1, to 200:1.

The thread-like structuring system can be made to have a viscosity of 0.002 $m^2/s$ (2,000 centistokes at 20° C.) or less at an intermediate shear range (5 $s^{-1}$ to 50 $s^{-1}$) which allows for the pouring of the detergent out of a standard bottle, while the low shear viscosity of the product at 0.1 $s^{-1}$ can be at least 0.002 $m^2/s$ (2,000 centistokes at 20° C.), but more preferably greater than 0.02 $m^2/s$ (20,000 centistokes at 20° C.). A process for the preparation of a thread-like structuring system is disclosed in WO 02/18528.

(b) Surfactants

The present compositions may optionally comprise and preferably do comprise at least one surfactant selected from the group consisting of nitrogen-free nonionic surfactants, nitrogen-containing surfactants and anionic surfactants, and mixtures thereof. Preferably the surfactant is selected from the group consisting of nitrogen-free nonionic surfactants, cationic nitrogen-containing surfactants, amine-oxide surfactants, amine- and amide-functional surfactants (including fatty amidoalkylamides) and mixtures thereof. Suitable levels of this component, if present, are in the range from 0.1% to 80%, preferably from 0.5% to 50%, more preferably from 1% to 30% by weight of the composition.

(b1) Nitrogen-free Nonionic Surfactant

The present compositions may optionally comprise and preferably do comprise this type of surfactant. Suitable levels of this component, if present, are in the range from 0.1% to 80%, preferably from 0.5% to 50%, more preferably from 1% to 30% by weight of the composition. Suitable surfactants of this type can be prepared from alkoxylates, including ethylene oxide, propylene oxide, butylene oxide and mixed alkylene oxide condensates of any suitable detergent alcohols having linear of branched hydrocarbyl moieties. Examples include: $C_8$–$C_{18}$ alkyl and/or alkylaryl alkoxylates, especially the ethoxylates, containing from 1 to 22 moles of ethylene oxide. This includes the so-called narrow peaked alkyl ethoxylates and the $C_6$–$C_{12}$ alkyl phenol eyhoxylates, especially nonylphenyl ethoxylates. The alcohols can be primary, secondary, Guerbet, mid-chain branched, or of any other branched type, especially the more biodegradable types. Commercially available materials can be obtained from Shell Chemical, Condea, or Procter & Gamble.

Other nonionic surfactants for use herein include, but are not limited to: alkylpolysaccharides disclosed in U.S. Pat. No. 4,565,647, Llenado, issued Jan. 21, 1986, having a hydrophobic group containing from 6 to 30 carbon atoms, preferably from 10 to 16 carbon atoms and a polysaccharide, e.g., a polyglycoside having a hydrophilic group containing from 1.3 to 10 polysaccharide units. Any reducing saccharide containing 5 or 6 carbon atoms can be used. Optionally the hydrophobic group is attached at the 2-, 3-, 4-, etc. positions thus giving a glucose or galactose as opposed to a glucoside or galactoside. The intersaccharide bonds can be, e.g., between the one position of the additional saccharide units and the 2-, 3-, 4-, and/or 6-positions on the preceding saccharide units. Preferred alkylpolyglycosides have the formula $RO(C_nH_{2n}O)_t(glycosyl)_x$ wherein R is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n is 2 or 3, preferably 2; t is from 0 to 10, preferably 0; and x is from 1.3 to 10, preferably from 1.3 to 3, most preferably from 1.3 to 2.7, and the glycosyl is preferably derived from glucose.

(b2) Nitrogen-containing Surfactant

Suitable levels of this component, if present, are in the range from 0.1% to 20%, more preferably from 0.5% to 15%, typically from 1% to 10% by weight of the composition. The nitrogen-containing surfactant herein is preferably selected from cationic nitrogen-containing surfactants, amine oxide surfactants, amine and amide-functional surfactants (including fatty amidoalkylamines) and mixtures thereof. The nitrogen-containing surfactant does not include silicone surfactants. Different surfactants of this type can be combined in varying proportions.

(b2i) Cationic Nitrogen-containing Surfactants

Cationic nitrogen-containing surfactants suitable for use in the compositions of the present invention have at least one quaternized nitrogen and one long-chain hydrocarbyl group. Compounds comprising two, three or even four long-chain hydrocarbyl groups are also included. Examples of such cationic surfactants include alkyltrimethylammonium salts or their hydroxyalkyl substituted analogs, preferably compounds having the formula $R_1R_2R_3R_4N^+X^-$. $R_1$, $R_2$, $R_3$ and $R_4$ are independently selected from $C_1$–$C_{26}$ alkyl, alkenyl, hydroxyalkyl, benzyl, alkylbenzyl, alkenylbenzyl, benzylalkyl, benzylalkenyl and X is an anion. The hydrocarbyl groups $R_1$, $R_2$, $R_3$ and $R_4$ can independently be alkoxylated, preferably ethoxylated or propoxylated, more preferably ethoxylated with groups of the general formula $(C_2H_4O)_xH$ where x has a value from 1 to 15, preferably from 2 to 5. Not more than one of $R_2$, $R_3$ or $R_4$ should be benzyl. The hydrocarbyl groups $R_1$, $R_2$, $R_3$ and $R_4$ can independently comprise one or more, preferably two, ester-([—O—C(O)—]; [—C(O)—O—]) and/or an amido-groups ([O—N(R)—]; [—N(R)—O—]) wherein R is defined as $R_1$ above. The anion X may be selected from halide, methysulfate, acetate and phosphate, preferably from halide and methylsulfate, more preferably from chloride and bromide. The $R_1$, $R_2$, $R_3$ and $R_4$ hydrocarbyl chains can be fully saturated or unsaturated with varying Iodine value, preferably with an Iodine value of from 0 to 140. At least 50% of each long chain alkyl or alkenyl group is predominantly linear, but also branched and/or cyclic groups are included.

For cationic surfactants comprising only one long hydrocarbyl chain, the preferred alkyl chain length for $R_1$ is $C_{12}$–$C_{15}$ and preferred groups for $R_2$, $R_3$ and $R_4$ are methyl and hydroxyethyl.

For cationic surfactants comprising two or three or even four long hydrocarbyl chains, the preferred overall chain length is $C_{18}$, though mixtures of chainlengths having non-zero proportions of lower, e.g., $C_{12}$, $C_{14}$, $C_{16}$ and some higher, e.g., $C_{20}$ chains can be quite desirable.

Preferred ester-containing surfactants have the general formula $$\{(R_5)_2N((CH_2)_nER_6)_2\}^+X^-$$

wherein each $R_5$ group is independently selected from $C_{1-4}$ alkyl, hydroxyalkyl or $C_{2-4}$ alkenyl; and wherein each $R_6$ is independently selected from $C_{8-28}$ alkyl or alkenyl groups; E is an ester moiety i.e., —OC(O)— or —C(O)O—, n is an integer from 0 to 5, and $X^-$ is a suitable anion, for example chloride, methosulfate and mixtures thereof.

A second type of preferred ester-containing cationic surfactant can be represented by the formula: $\{(R_5)_3N(CH_2)_nCH(O(O)CR_6)CH_2O(O)CR_6\}^+X^-$ wherein $R_5$, $R_6$, X, and n are defined as above. This latter class can be exemplified by 1,2 bis[hardened tallowoyloxy]-3-trimethylammonium propane chloride.

The cationic surfactants, suitable for use in the compositions of the present invention can be either water-soluble, water-dispersable or water-insoluble.

(b2ii) Amine Oxide Surfactants

These surfactants have the formula: $R(EO)_x(PO)_y(BO)_zN(O)(CH_2R')_2qH_2O$ (I). R is a relatively long-chain hydrocarbyl moiety which can be saturated or unsaturated, linear or branched, and can contain from 8 to 20, preferably from 10 to 16 carbon atoms, and is more preferably C12–C16 primary alkyl. R' is a short-chain moiety preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide.

(b2iii) Amine and Amide Functional Surfactants

A preferred group of these surfactants are amine surfactants, preferably an amine surfactant having the formula $RX(CH_2)_xNR^2R^3$ wherein R is $C_6$–$C_{12}$ alkyl; X is a bridging group which is selected from NH; CONH, COO, or O or X ran be absent; x is from 2 to 4; $R_2$ and $R_3$ are each independently selected from H, $C_1$–$C_4$ alkyl, or ($CH_2$—$CH_2$—$O(R_4)$) wherein $R_4$ is H or methyl. Particularly preferred surfactants of this type include those selected from the group consisting of decyl amine, dodecyl amine, $C_8$–$C_{12}$ bis(hydroxyethyl)amine, $C_8$–$C_{12}$ bis(hydroxypropyl)amine, $C_8$–$C_{12}$ amido propyl dimethyl amine, and mixtures thereof.

This group of surfactants also includes fatty acid amide surfactants having the formula $RC(O)NR'_2$ wherein R is an alkyl group containing from 10 to 20 carbon atoms and each R' is a short-chain moiety preferably selected from the group consisting of hydrogen and $C_1$–$C_4$ alkyl and hydroxyalkyl. The $C_{10}$–$C_{18}$ N-alkyl polyhydroxy fatty acid amides can also be used. Typical examples include the $C_{12}$–$C_{18}$ N-methylglucamides. See WO 92/06154. Other sugar-derived nitrogen-containing nonionic surfactants include the N-alkoxy polyhydroxy fatty acid amides, such as $C_{10}$–$C_{18}$ N-(3-methoxypropyl) glucamide.

(b3) Anionic Surfactants

The compositions of the invention may comprise an anionic surfactant, preferably at least a sulphonic acid surfactant, such as a linear alkyl benzene sulphonic acid, but water-soluble salt forms may also be used. Suitable levels for this component, if present, are in the range of from 0.01% to 30%, preferably from 0.1% to 20% by weight, and more preferably from 0.15% to 5% by weight of the fabric treatment composition. In a preferred embodiment of the present invention, the composition comprises a low level of anionic surfactant in the range of from 0.15% to 5% wt. of the fabric treatment composition in combination with further surfactants, for example those described in (b2) to (b2iii) above.

Anionic sulfonate or sulfonic acid surfactants suitable for use herein include the acid and salt forms of C5–C20, more preferably C10–C16, more preferably C11–C13 alkylbenzene sulfonates, C5–C20 alkyl ester sulfonates, C6–C22 primary or secondary alkane sulfonates, C5–C20 sulfonated polycarboxylic acids, and any mixtures thereof, but preferably C11–C13 alkylbenzene sulfonates.

Anionic sulphate salts or acids surfactants suitable for use in the compositions of the invention include the primary and secondary alkyl sulphates, having a linear or branched alkyl or alkenyl moiety having from 9 to 22 carbon atoms or more preferably 12 to 18 carbon atoms.

Also useful are beta-branched alkyl sulphate surfactants or mixtures of commercial available materials, having a weight average (of the surfactant or the mixture) branching degree of at least 50%.

Mid-chain branched alkyl sulphates or sulfonates are also suitable anionic surfactants for use in the compositions of the invention. Preferred are the C5–C22, preferably C10–C20 mid-chain branched alkyl primary sulphates. When mixtures are used, a suitable average total number of carbon atoms for the alkyl moieties is preferably within the range of from greater than 14.5 to 17.5. Preferred monomethyl-branched primary alkyl sulphates are selected from the group consisting of the 3-methyl to 13-methyl pentadecanol sulphates, the corresponding hexadecanol sulphates, and mixtures thereof. Dimethyl derivatives or other biodegradable alkyl sulphates having light branching can similarly be used.

Other suitable anionic surfactants for use herein include fatty methyl ester sulphonates and/or alkyl ethyoxy sulphates (AES) and/or alkyl polyalkoxylated carboxylates (AEC). Mixtures of anionic surfactants can be used, for example mixtures of alkylbenzenesulphonates and AES.

The anionic surfactants are typically present in the form of their salts with alkanolamines or alkali metals such as sodium and potassium. Preferably, the anionic surfactants are neutralized with alkanolamines such as Mono Ethanol Amine or Triethanolamine, and are fully soluble in the liquid phase.

(c) Coupling Agent

Coupling agents suitable for use herein include fatty amines other than those which have marked surfactant character or are conventional solvents (such as the lower alkanolamines). Examples of these coupling agents include hexylamine, octylamine, nonylamine and their C1–C3 secondary and tertiary analogs. Suitable levels of this component, if present, are in the range of from 0.1% to 20%, more typically 0.5% to 5% by weight of the composition.

A particularly useful group of coupling agents is selected from the group consisting of molecules which consist of two polar groups separated from each other by at least 5, preferably 6, aliphatic carbon atoms; preferred compounds in this group are free from nitrogen and include 1,4-cyclohexane-di-methanol (CHDM), 1,6-hexanediol, 1,7-heptanediol and mixtures thereof. 1,4-cyclo-hexane-di-methanol may be present in either its cis-configuration, its trans-configuration or a mixture of both configurations.

(d) Detergent Builder

The compositions of the present invention may optionally comprise a builder, at levels of from 0.0% to 80% by weight, preferably from 5% to 70% by weight, more preferably from 20% to 60% by weight of the composition.

In general any known detergent builder is useful herein, including inorganic types such as zeolites, layer silicates, fatty acids and phosphates such as the alkali metal polyphosphates, and organic types including especially the alkali metal salts of citrate 2,2-oxydisuccinate, carboxymethyloxysuccinate, nitrilotriacetate and the like. Phosphate-free, water-soluble organic builders which have relatively low molecular weight, e.g., below 1,000, are highly preferred for use herein. Other suitable builders include sodium carbonate and sodium silicates having varying ratios of $SiO_2$:$Na_2O$ content, e.g., 1:1 to 3:1 with 2:1 ratio being typical. Most preferred builders are the alkali metal salts of citrate 2,2-oxydisuccinate, carboxymethyloxysuccinate, nitrilotriacetate.

Other suitable builders are $C_{12}$–$C_{18}$ saturated and/or unsaturated, linear and/or branched, fatty acids, but preferably mixtures of such fatty acids. Highly preferred have been found mixtures of saturated and unsaturated fatty acids, for example preferred is a mixture of rape seed-derived fatty acid and $C_{16}$–$C_{18}$ topped whole cut fatty acids, or a mixture of rape seed-derived fatty acid and a tallow alcohol derived fatty acid, palmitic, oleic, fatty alkylsuccinic acids, and mixtures thereof. Further preferred are branched fatty acids of synthetic or natural origin, especially biodegradable branched types.

(e) Fabric Substantive Perfume

The fabric treatment compositions of the present invention can comprise perfume to provide a "scent signal" in the form of a pleasant odor which provides a freshness impression to the washed fabrics. The fabric substantive perfume ingredients are suitably at levels in the range from 0.0001% to 10% by weight of the composition and are characterized by their boiling points (B.P.). The fabric substantive perfume ingredients have a B.P, measured at the normal, standard pressure of 760 mm Hg, of 240° C. or higher, and preferably of 250° C. or higher. Preferably the fabric substantive perfume ingredients have a ClogP of greater than 3, more preferably from 3 to 6.

The preferred compositions used in the present invention contain at least 2, preferably at least 3, more preferably at least 4, even more preferably at least 5, even more preferably at least 6, and even more preferably at least 7 different fabric substantive perfume ingredients. Most common perfume ingredients which are derived from natural sources are composed of a multitude of components. When each such material is used in the formulation of the preferred perfume compositions of the present invention, it is counted as one single ingredient, for the purpose of defining the invention.

Nonlimiting examples of suitable fabric substantive perfume ingredients for use in the compositions of the present invention are disclosed in WO 02/18528.

(f) Scavenger Agent

The compositions of the present invention may comprise at least 0.001%, preferably from 0.5% to 10%, most preferably to 5% by weight, of one or more scavenger agents. Scavenger agents suitable for use herein are selected from scavengers selected to capture fugitive dyes and/or anionic surfactants and/or soils.

Preferred scavenger agents are selected from the group consisting of fixing agents for anionic dyes, complexing agents for anionic surfactants, clay soil control agents and mixtures thereof. These materials can be combined at any suitable ratio. Suitable compounds are included in commonly patents to Gosselink et al and are commercially available from BASF, Ciba and others.

(fi) Fixing Agents for Anionic Dyes

Dye fixing agents, "fixatives", or "fixing agents" are well-known, commercially available materials which are designed to improve the appearance of dyed fabrics by minimizing the loss of dye from fabrics due to washing. Not included within this definition are components which can in some embodiments serve as fabric softener actives.

Many fixing agents for anionic dyes are cationic, and are based on quaternized nitrogen compounds or on nitrogen compounds having a strong cationic charge which is formed in situ under the conditions of usage.

Fixing agents are available under various trade names from several suppliers. Representative examples include: CROSCOLOR PMF (July 1981, Code No. 7894) and CROSCOLOR NOFF (January 1988, Code No. 8544) ex Crosfield; INDOSOL E-50 (Feb. 27, 1984, Ref. No. 6008.35.84; polyethyleneimine-based) ex Sandoz; SANDOFIX TPS, ex Sandoz, is a preferred dye fixative for use herein. Additional non-limiting examples include SANDOFIX SWE (a cationic resinous compound) ex Sandoz, REWIN SRF, REWIN SRF-O and REWIN DWR ex CHT-Beitlich GMBH; Tinofix® ECO, Tinofix® FRD and Solfin® ex Ciba-Geigy and described in WO 99/14301. Other preferred fixing agents for use in the compositions of the present invention are CARTAFIX CB® ex Clariant and the cyclic amine based polymers, oligomers or copolymers described in WO 99/14300.

Other fixing agents useful herein are described in "After-treatments for Improving the Fastness of Dyes on Textile Fibres", Christopher C. Cook, *Rev. Prog. Coloration*, Vol. XII, (1982). Dye fixing agents suitable for use in the present invention are ammonium compounds such as fatty acid-diamine condensates, inter alia the hydrochloride, acetate, methosulphate and benzyl hydrochloride salts of diamine esters. Non-limiting examples include oleyldiethyl aminoethylamide, oleylmethyl diethylenediamine methosulphate, and monostearylethylene diaminotrimethylammonium methosulphate. In addition, N-oxides other than surfactant-active N-oxides, more particularly polymeric N-oxides such as polyvinylpyridine N-oxide, are useful as fixing agents herein. Other useful fixing agents include derivatives of polymeric alkyldiamines, polyamine-cyanuric chloride condensates, and aminated glycerol dichlorohydrins.

Fixing agents for anionic dyes can be used in the present methods either in the form of such agents fully integrated into the inventive compositions, or by including them in a laundry treatment method according to the invention in the form of a separate article, for example a substrate article or sheet, which can be added to the wash along with the cationic silicone containing composition. In this manner, the fixing agent can complement the use of the cationic silicone composition. Combinations of such dye fixing articles and compositions comprising the cationic silicones can be sold together in the form of a kit.

(fii) Scavenger Agents for Anionic Surfactants and/or Soils

Suitable scavenger agents for anionic surfactants and/or soils include alkoxylated polyalkyleneimines and/or quaternized derivatives thereof and/or mono- and/or poly cationic mono and/or poly-quaternary ammonium based compounds.

(g) Enzyme

Suitable enzymes for use herein include protease, amylase, cellulase, mannanase, endoglucanase, lipase and mixtures thereof. Enzymes can be used at their art-taught levels, for example at levels recommended by suppliers such as Novo and Genencor. Preferred levels in the compositions are from 0% to 5%, more preferably from 0.0001% to 5% by weight of the composition. When enzymes are present, they can be used at very low levels, e.g., from 0.001% or lower, in certain embodiments of the invention; or they can be used in heavier-duty laundry detergent formulations in accordance with the invention at higher levels, e.g., 0.1% and higher. In accordance with a preference of some consumers for "non-biological" detergents, the present invention includes both enzyme-containing and enzyme-free embodiments.

(h) Chelating Agent

Suitable chelating agents for use herein include nitrogen-containing, P-free aminocarboxylates such as EDDS, EDTA and DTPA; aminophosphonates such as diethylenetriamine pentamethylenephosphonic acid and, ethylenediamine tetramethylenephosphonic acid; nitrogen-free phosphonates e.g., HEDP; and nitrogen or oxygen containing, P-free carboxylate-free chelating agents such as compounds of the general class of certain macrocyclic N-ligands such as those known for use in bleach catalyst systems. Levels of chelating agents are typically lower than 5%, more typically, chelating agents, when present, are at levels of from 0.01%to 3%.

(i) Solvent System

The solvent system in the present compositions can be anhydrous or hydrous; and can include water alone or organic solvents alone and/or mixtures thereof. Preferred organic solvents include 1,2-propanediol, ethanol, glycerol and mixtures thereof. Other lower alcohols, $C_1$–$C_4$ alkanolamines such as monoethanolamine and triethanolamine, can also be used. Solvent systems can be absent, for example from anhydrous solid embodiments of the invention, but more typically are present at levels in the range of from 0.1% to 98%, preferably at least 10% to 95%, more usually from 25% to 75% by weight of the composition.

(j) Effervescent System

Effervescent systems suitable herein include those derived by combining an acid and a bicarbonate or carbonate, or by combining hydrogen peroxide and catalase, or any other combination of materials which release small bubbles of gas. The components of the effervescent system may be dispensed in combination to form the effervescence when they are mixed, or can be formulated together provided that conventional coatings or protection systems are used. Levels of effervescent system can vary very widely, for example effervescent components together can range from 0.1% to 30% of the composition. Hydrogen peroxide and catalase are very mass efficient and can be at much lower levels with excellent results.

(k) Other Adjuncts

Examples of other suitable cleaning adjunct materials include, but are not limited to, alkoxylated benzoic acids or salts thereof such as trimethoxy benzoic acid or a salt thereof (TMBA), conventional (not fabric substantive) perfumes and pro-perfumes, zwitterionic and/or amphoteric surfactants, bleaches, bleach activators, bleach catalysts, enzyme stabilizing systems, optical brighteners or fluorescers, soil release polymers, dispersants or polymeric organic builders including water-soluble polyacrylates, acrylate/maleate copolymers, suds suppressors, dyes, colorants, filler salts such as sodium sulfate, hydrotropes such as toluenesulfonates, cumenesulfonates and naphthalenesulfonates, photoactivators, hydrolyzable surfactants, preservatives, anti-oxidants, anti-shrinkage agents, anti-wrinkle agents, germicides, fungicides, color speckles, colored beads, spheres or extrudates, sunscreens, fluorinated compounds, clays, pearlescent agents, luminescent agents or chemiluminescent agents, anti-corrosion and/or appliance protectant agents, alkalinity sources or other pH adjusting agents, solubilizing agents, carriers, processing aids, pigments, free radical scavengers, and pH control agents. Suitable materials include those described in U.S. Pat. Nos. 5,705,464, 5,710,115, 5,698,504, 5,695,679, 5,686,014 and 5,646,101.

Process for Preparing the Fabric Treatment Composition

The fabric treatment compositions of the present invention can be prepared in any suitable manner and can, in general, involve any order of mixing or addition. However, there is a preferred way to make such a preparation.

The first step involves the preparation of a premix comprising the cationic silicone polymer and the nitrogen-free silicone polymer of the present invention. Optionally, it may be desirable to add one or more ingredients selected from the group of a solvent system, surfactants, silicone surfactants and low-viscosity silicone-containing solvents and mixtures thereof. The second step involves the preparation of a second premix comprising all other remaining laundry adjunct materials. The third step involves the combination of the two premixes cited above.

This process for preparing the fabric treatment composition of the present invention is preferably carried out using conventional high-shear mixing means. This ensures proper dispersion of the cationic silicone polymer and of the nitrogen-free silicone polymer throughout the final composition.

Liquid compositions, especially liquid detergent compositions in accordance with the invention preferably comprise a stabilizer, especially preferred being trihydroxystearin or hydrogenated castor oil, for example the type commercially available as Thixcin®. When a stabilizer is to be added to the present compositions, it is preferably introduced as a separate stabilizer premix with one or more of the adjuncts, or non-silicone components, of the composition. When such a stabilizer premix is used, it is preferably added into the composition after the cationic silicone polymer and after the nitrogen-free silicone polymer have already been introduced and dispersed in the composition.

Forms and Types of the Compositions

The fabric treatment composition of the present invention may be in any form, such as liquids (aqueous or non-aqueous), granules, pastes, powders, sprays, foams, tablets, and gels. Unitized dose compositions are included, as are compositions, which form two or more separate but combined dispensable portions. Granular compositions can be in "compact" or "low density" form and the liquid compositions can also be in a "concentrated" or diluted form. Preferred fabric treatment compositions of the present invention include liquids, more preferably heavy duty liquid fabric treatment compositions and liquid laundry detergents for washing 'standard', non-fine fabrics as well as fine fabrics including silk, wool and the like. Compositions formed by mixing the provided compositions with water in widely ranging proportions are included.

The fabric treatment composition of the present invention may also be present in form of a rinse-added composition for delivering fabric care benefits, e.g., in form of a rinse-added fabric-softening composition, or in form of a fabric finishing composition, or in form of a wrinkle-reduction composition.

The fabric treatment compositions of the present invention may be in the form of spray compositions, preferably contained within a suitable spray dispenser. The present invention also includes products in a wide range of types such as single-phase compositions, as well as dual-phase or even multi-phase compositions. The fabric treatment compositions of the present invention may be incorporated and stored in a single-, dual-, or multi-compartment bottle.

The cationic silicone and the nitrogen-free silicone polymer of the present invention form a particle within the liquid fabric treatment composition of the present invention. The average particle size of these particles measured by number weight is typically below 30 $\mu$m, preferably between 0.05 $\mu$m and 25 $\mu$m, more preferably between 0.1 $\mu$m and 20 $\mu$m, and most preferably between 1 $\mu$m and 15 $\mu$m.

Particle Size Measurement

The silicone particle size is measured using the Coulter Multisizer a multichannel particle size analyzer. The sample is prepared by adding 0.25 g of finished product in 199.75 g of demineralised water. This sample is then mixed for 1 min. with a magnetic stirrer bar (40 mm length–8 mm width) on a magnetic stirrer plate—stirring speed 750 rpm. The particle size is measured by following the instructions in the manual.

Method of Treating Fabrics and Uses of Compositions of the Invention in Relation to Form The term "substrate" as used herein means a substrate, especially a fabric or garment, having one or more of the fabric care benefits described herein as imparted thereto by a composition having the selected cationic silicone polymer and the nitrogen-free silicone polymer of the invention.

A method of treating a substrate comprising the steps of contacting the substrate with the fabric treatment composition of the present invention is incorporated in the present invention. As used herein, "fabric treatment compositions" include fabric treatment compositions for handwash, machine wash and other purposes including fabric care additive compositions and compositions suitable for use in the soaking and/or pretreatment of stained fabrics.

Even though fabric treatment compositions are specifically discussed herein, compositions comprising the cationic silicone polymers and the nitrogen-free silicone polymer of the present invention for use in treating, cleaning, conditioning, and/or refreshing both natural and synthetic fibers are encompassed by the present invention.

EXAMPLES

The following non-limiting examples are illustrative of the present invention. Percentages are by weight unless otherwise specified.

For purposes of this invention, viscosity is measured with a Carrimed CSL2 Rheometer at a shear rate of 21 $s^{-}$.

Example (1)

Preparation of a Fabric Treatment Composition Providing Cleaning Benefits and Fabric Care Benefits The final fabric treatment composition is formulated by combining two premixes: a fabric cleaning premix A according to formula A1 or A2 as below and a fabric care premix B according to formula B1, B2, B3 or B4 as below.

Fabric cleaning Premixes A (Formula A1 and A2)

| | Wt % in Formula A1 | Wt % in Formula A2 |
|---|---|---|
| Lutensol 35-7 (1) | 12.0 | 12.0 |
| C12–14 amineoxide | 4.0 | 4.0 |
| C13–15 alkylbenzene sulphonic acid | — | 0.2 |
| C13–15 hydroxyethyl dimethyl ammonium chloride | — | 1.0 |
| Citric acid | 5.0 | 5.0 |
| Diethylene triamine pentamethylene phosphonic acid | 0.3 | 0.3 |
| Hydroxyethane dimethylene phosphonic acid | 0.2 | 0.2 |
| Ethoxylated polyethylene imine | 1.0 | 1.0 |
| Ethoxylated tetraethylene pentamine | 1.2 | 1.2 |
| Boric acid | 2.0 | 2.0 |
| $CaCl_2$ | 0.02 | 0.02 |
| Propanediol | 10.0 | 10.0 |
| Ethanol | 0.4 | 0.4 |
| Monoethanolamine | to pH 7.0–8.0 | to pH 7.0–8.0 |
| Protease enzyme | 0.50 | 0.50 |
| Amylase enzyme | 0.22 | 0.22 |
| Cellulase enzyme | 0.01 | 0.01 |
| Mannanase enzyme | 0.04 | 0.04 |
| Hydrogenated castor oil | 0.5 | 0.5 |
| Suds suppressor | 0.2 | 0.2 |
| Dye | 0.001 | 0.001 |
| Perfume | 0.8 | 0.8 |
| Water | Balance | Balance |

Fabric care premixes B (Formula B1 to B4)

| Wt. % in premix | Formula B1 | Formula B2 | Formula B3 | Formula B4 |
|---|---|---|---|---|
| PDMS 0.0125 $m^2/s$ (12,500 centistokes at 20° C.) (2) | 87.7 | — | — | — |
| PDMS 0.06 $m^2/s$ (60,000 centistokes at 20° C.) (2) | — | 37.9 | — | — |
| PDMS 0.1 $m^2/s$ (100,000 centistokes at 20° C.) (2) | — | — | 31.8 | — |
| PDMS 0.6 $m^2s$ (600,000 centistokes at 20° C.) (2) | | | | 27.3 |

-continued

Fabric care premixes B (Formula B1 to B4)

| Wt. % in premix | Formula B1 | Formula B2 | Formula B3 | Formula B4 |
|---|---|---|---|---|
| Cationic silicone solution (3) | 12.3 | 5.3 | 4.5 | — |
| Cationic silicone solution (4) | — | — | — | 10.0 |
| DC3225C (5) | — | 37.9 | 47.8 | — |
| Isopropanol | — | 18.9 | 15.9 | — |
| C45 EO7 nonionic surfactant (6) | — | — | — | 13.6 |
| Demineralized water | — | — | — | 49.1 |

Fabric care premix B1 is made by adding 2.8 g of the cationic silicone solution (3) to 20.0 g of polydimethylsiloxane (PDMS) 0.0125 $m^2/s$ (12,500 centistokes at 20° C.) using a normal laboratory blade mixer (type: Janke & Kunkel, IKA-Labortechnik RW 20). The premix is stirred for 15 minutes.

Fabric care premix B2 is made by adding 2.8 g of the cationic silicone solution (3) to 20.0 g of PDMS 0.06 $m^2/s$ (60,000 centistokes at 20° C.) using a normal laboratory blade mixer. After stirring for 10 minutes, the mixture is diluted with 20.0 g of DC3225C and with 10.0 g of isopropanol.

Fabric care premix B3 is made by adding 2.8 g of the cationic silicone solution (3) to 20.0 g of PDMS 0.1 $m^2/s$ (100,000 centistokes at 20° C.) using a normal laboratory blade mixer. After stirring for 10 minutes, the mixture is diluted with 30.0 g of DC3225C and with 10.0 g of isopropanol.

Fabric care premix B4 is made by blending 54.6 g of PDMS 0.6 $m^2/s$ (600,000 centistokes at 20° C.) and 27.2 g C45 EO7 (6) nonionic surfactant with a normal blade mixer. After stirring for 10 minutes, 20.0 g of the cationic silicone solution (4) are added. After stirring for 15 minutes, the mixture is diluted with 98.2 g of demineralized water and is stirred for 15 minutes.

To formulate the final fabric treatment composition, 2.3 g of premix B1, or 5.3 g of premix B2, or 6.3 g of premix B3 is added to 100 g of premix A1 by using a normal laboratory blade mixer to give three distinctive fabric treatment compositions containing either premixes A1 and B 1, or premixes A1 and B2, or premixes A1 and B3.

To formulate the final fabric treatment composition, 3.7 g of premix B4 is added to 100 g of premix A2 by using a normal laboratory blade mixer.

(1) Lutensol 35-7: $C_{13}$ and $C_{15}$ alcohol ethoxylated with 7 eq. moles of ethylene oxide on average ex BASF.

(2): Polydimethylsiloxane (PDMS) with viscosities of 0.0125 $m^2/s$ (12,500 centistokes at 20° C.), 0.06 $m^2/s$ (60,000 centistokes at 20° C.); 0.1 $m^2/s$ (100,000 centistokes at 20° C.) and 0.6 $m^2/s$ (600,000 centistokes at 20° C.) (Silicone 200 fluid series from Dow Corning).

(3) Cationic silicone structure as in structure 2b: (i) with: $R^1$, $R^3=CH_3$, $R^2=(CH_2)_3$, $X=CH_2CHOHCH_2$, a=0; b=1; c=150; d=0; cationic divalent moiety: ii(a) with $R^4$, $R^5$, $R^6$, $R^7$ all $CH_3$ and $Z^1$ is $(CH_2)_6$. A=50% by mole of acetate, 50% by mole of laurate, m=2; polyalkyleneoxide amine moiety (iii) is $—NHCH(CH_3)CH_2.[OCH(CH_3)CH_2]_r—[OCH_2CH_2]_{38.7}—[OCH_2CH(CH_3)]_z—NH—$ with r+z=6.0; cationic monovalent moiety iv(i) has $R^{12}$, $R^{13}$ and $R^{14}$ all methyl. The mole fractions of the cationic divalent moiety (ii) of the polyalkyleneoxide amine moiety (iii) and of the cationic monovalent amine moiety (iv) are respectively 0.8, 0.1 and 0.1 expressed as fractions of the total moles of the organosilicone-free moieties. The cationic silicone is present as a 72.1 wt.-% solution in isopropanol.

(4): Cationic silicone structure as in (3) but present as a 82 wt.-% solution in ethanol.

(5): DC3225C is an ethoxylated silicone emulsifier ex Dow Corning.

(6): $C_{14}$, and $C_5$ alcohol ethoxylated with 7 eq. moles of ethylene oxide on average (Neodol® 45-AE 7) ex Shell.

Example (2)

Preparation of a Rinse Added Fabric Treatment Composition

The final rinse added fabric treatment composition is formulated by combining two distinctive premixes: Premix C as below and premix D as below.

Premix D is prepared by mixing 24.39 g of cationic silicone solution and 40.0 g of PDMS 0.1 $m^2/s$ (100,000 centistokes at 20° C.), using a normal laboratory blade mixer. The premix is stirred for 20 minutes.

To formulate the final rinse added fabric treatment composition, 3.22 g of premix D is added to 100 g of premix C by using a normal laboratory blade mixer.

Rinse added fabric treatment composition Premix C

| | Wt % |
|---|---|
| Diester of tallow fatty acid and diethanol dimethyl ammonium chloride | 15.0 |
| Hydrogenchloride | 0.02 |
| Soil release polymer | 0.1 |
| $CaCl_2$ | 0.09 |
| Dye | 0.003 |
| Perfume | 1.0 |
| Water | Balance |

Fabric care premix D

| | Wt % |
|---|---|
| PDMS 0.1 $m^2/s$ (100,000 centistokes at 20° C.) (2) | 62.1 |
| Cationic silicone (4) | 37.9 |

What is claimed is:

1. A fabric treatment composition comprising (a) at least one cationic silicone polymer comprising one or more polysiloxane units and one or more quaternary nitrogen moieties; and (b) one or more nitrogen-free silicone polymers;

wherein the ratio, by weight, of the cationic silicone polymer to the nitrogen-free silicone polymer is from about 10:1 to about 0.01:1.

2. A fabric treatment composition according to claim 1, wherein the ratio, by weight, of the cationic silicone polymer to the nitrogen-free silicone polymer is from about 1:1 to about 0.1:1.

3. A fabric treatment composition according to claim 1 wherein the cationic silicone polymer has the formula:

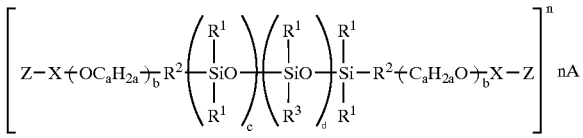

wherein:

$R^1$ is independently selected from the group consisting of $C_{1-22}$ alkyl, $C_{2-22}$ alkenyl, $C_{6-22}$ alkylaryl, aryl, cycloalkyl, and mixtures thereof;

$R^2$ is independently selected from the group consisting of divalent organic moieties;

X is independently selected from the group consisting of ring-opened epoxides;

$R^3$ is independently selected from polyether groups having the formula:

$$—M^1(C_aH_{2a}O)_b—M^2$$

wherein $M^1$ is a divalent hydrocarbon residue; $M^2$ is independently selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof;

Z is independently selected from the group consisting of monovalent organic moieties comprising at least one quaternized nitrogen atom;

a is from about 2 to about 4; b is from 0 to about 100; c is from about 1 to about 1000; d is from 0 to about 100; n is the number of positive charges associated with the cationic silicone polymer, which is greater than or equal to about 2; and A is a monovalent anion.

4. A fabric treatment composition according to claim 3 wherein Z is independently selected from the group consisting of:

(i)

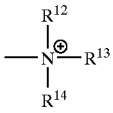

(ii)

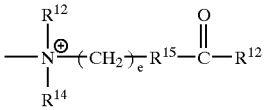

(iii)

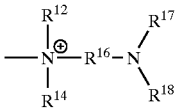

(iv)

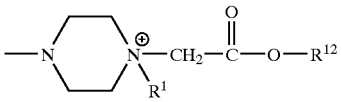

(v)

monovalent aromatic or aliphatic heterocyclic group, substituted or unsubstituted, containing at least one quaternized nitrogen atom;

wherein:

$R^{12}$, $R^{13}$, $R^{14}$ are the same or different, and are selected from the group consisting of $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof;

$R^{15}$ is —O— or $NR^{19}$;

$R^{16}$ is a divalent hydrocarbon residue;

$R^{17}$, $R^{18}$, $R^{19}$ are the same or different, and are selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof; and e is from about 1 to about 6.

5. A fabric treatment composition according to claim 1 wherein the cationic silicone polymer is composed of alternating units of:

(i) a polysiloxane of the following formula:

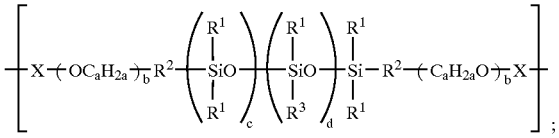

and (ii) a divalent organic moiety comprising at least two quaternized nitrogen atoms;

wherein:

$R^1$ is independently selected from the group consisting of $C_{1-22}$ alkyl, $C_{2-22}$ alkenyl, $C_{6-22}$ alkylaryl, aryl, cycloalkyl, and mixtures thereof;

$R^2$ is independently selected from the group consisting of divalent organic moieties;

X is independently selected from the group consisting of ring-opened epoxides;

$R^3$ is independently selected from polyether groups having the formula:

$$—M^1(C_aH_{2a}O)_b—M^2$$

wherein $M^1$ is a divalent hydrocarbon residue; $M^2$ is independently selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof;

a is from about 2 to about 4; b is from 0 to about 100; c is from about 1 to about 1000; and d is from 0 to about 100.

6. A fabric treatment composition according to claim 1 wherein the cationic silicone polymer is composed of alternating units of:

(i) a polysiloxane of the following formula:

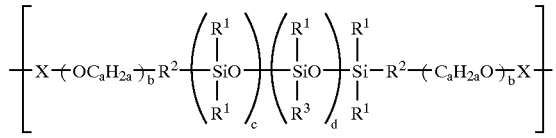

and (ii) a cationic divalent organic moiety selected from the group consisting of:

(a)

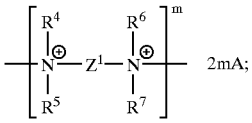

2mA;

(b)

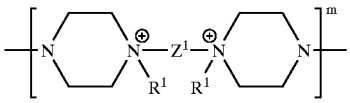

2mA;

(c)

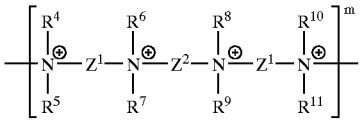

4mA;

(d)

a divalent aromatic or aliphatic heterocyclic group, substituted or unsubstituted, containing at least one quaternized nitrogent atom; and mixtures thereof;

wherein $R^1$ is independently selected from the group consisting of $C_{1-22}$ alkyl, $C_{2-22}$ alkenyl, $C_{6-22}$ alkylaryl, aryl, cycloalkyl, and mixtures thereof;

$R^2$ is independently selected from the group consisting of divalent organic moieties;

X is independently selected from the group consisting of ring-opened epoxides;

$R^3$ is independently selected from polyether groups having the formula:

$$—M^1(C_aH_{2a}O)_b—M^2$$

wherein $M^1$ is a divalent hydrocarbon residue; $M^2$ is independently selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof;

$R^4$, $R^5$, $R^6$, $R^7$, $R^8$, $R^9$, $R^{10}$, $R^{11}$ are the same or different, and are selected from the group consisting of $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl and mixtures thereof; or in which $R^4$ and $R^6$, or $R^5$ and $R^7$, or $R^8$ and $R^{10}$, or $R^9$ and $R^{11}$ are components of a bridging alkylene group;

$Z^1$ and $Z^2$ are the same or different divalent hydrocarbon groups each comprising at least about 2 carbon atoms;

a is from about 2 to about 4; b is from 0 to about 100; c is from about 1 to about 1000; d is from 0 to about 100;

m is the number of positive charges associated with the cationic divalent organic moiety, which is greater than or equal to about 2; A is an anion; and wherein, expressed as fractions on the total moles of the organosilicone-free moieties, and the cationic divalent organic moiety (ii) is present at of from about 0.05 to about 1.0 mole fraction.

7. A fabric treatment composition according to claim 6 wherein the cationic silicone further comprises a polyalkyleneoxide amine of formula:

$$[—Y—O(—C_aH_{2a}O)_b—Y—]$$

wherein Y is a divalent organic group comprising a secondary or tertiary amine; a is from about 2 to about 4 and b is from 0 to about 100; and the polyalkyleneoxide amine is present of from 0.0 to about 0.95 mole fraction.

8. A fabric treatment composition according to claim 6 wherein the cationic silicone further comprises an end-group cationic monovalent organic moiety selected from the group consisting of:

(i)

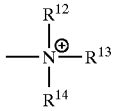

(ii)

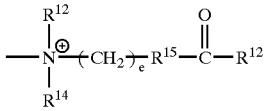

(iii)

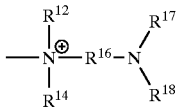

(iv)

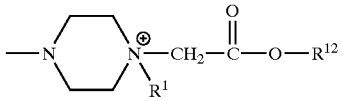

(v)

monovalent aromatic or aliphatic heterocyclic group, substituted or unsubstituted, containing at least one quaternized nitrogen atom;

wherein:

$R^{12}$, $R^{13}$, $R^{14}$ are the same or different, and are selected from the group consisting of $C_{1-22}$ alkyl, $C_{2-22}$ alkenyl, $C_{6-22}$ alkylaryl, $C_{1-22}$ hydroxyalkyl, polyalkyleneoxide, (poly)alkoxy alkyl groups, and mixtures thereof;

$R^{15}$ is —O— or $NR^{19}$;

$R^{16}$ is divalent hydrocarbon residue;

$R^{17}$, $R^{18}$, $R^{19}$ are the same or different, and are selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof; e is from about 1 to about 6; and the cationic monovalent organic moiety is present of from 0 to about 0.2 mole fraction.

9. A fabric treatment composition according to claim 7 wherein the cationic silicone further comprises an end-group cationic monovalent organic moiety selected from the group consisting of:

(i)

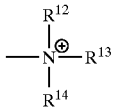

(ii)

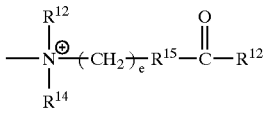

-continued (iii)

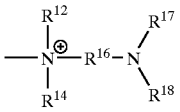

(iv)

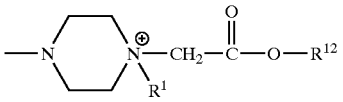

(v)

monovalent aromatic or aliphatic heterocyclic group, substituted or unsubstituted, containing at least one quaternized nitrogen atom;

wherein:

$R^{12}$, $R^{13}$, $R^{14}$ are the same or different, and are selected from the group consisting of $C_{1-22}$ alkyl, $C_{2-22}$ alkenyl, $C_{6-22}$ alkylaryl, $C_{1-22}$ hydroxyalkyl, polyalkyleneoxide, (poly)alkoxy alkyl groups, and mixtures thereof;

$R^{15}$ is —O— or $NR^{19}$;

$R^{16}$ is divalent hydrocarbon residue;

$R^{17}$, $R^{18}$, $R^{19}$ are the same or different, and are selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof; e is from about 1 to about 6; and the cationic monovalent organic moiety is present of from 0 to about 0.2 mole fraction.

10. A fabric treatment composition according to claim 1 wherein the cationic silicone polymer has the formula:

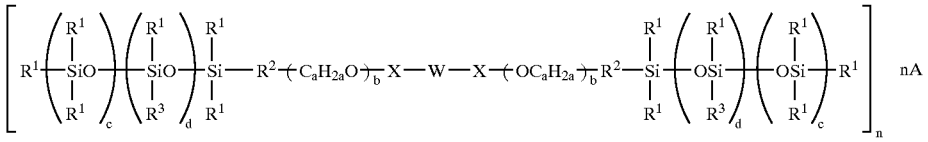

wherein:

$R^1$ is independently selected from the group consisting of $C_{1-22}$ alkyl, $C_{2-22}$ alkenyl, $C_{6-22}$ alkylaryl, aryl, cycloalkyl, and mixtures thereof;

$R^2$ is independently selected from the group consisting of divalent organic moieties;

X is independently selected from the group consisting of ring-opened epoxides;

$R^3$ is independently selected from polyether groups having the formula:

$$—M^1(C_aH_{2a}O)_b—M^2$$

wherein $M^1$ is a divalent hydrocarbon residue; $M^2$ is selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof;

W is independently selected from the group consisting of divalent organic moieties comprising at least one quaternized nitrogen atom;

a is from about 2 to about 4; b is from 0 to about 100; c is from about 1 to about 1000; d is from 0 to about 100; n is the number of positive charges associated with the cationic silicone polymer, which is greater than or equal to about 1; and A is a counterion.

11. A fabric treatment composition according to claim 10 wherein W is selected from the group consisting of:

(a)

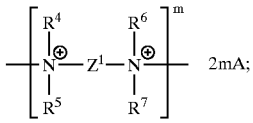

2mA;

(b)

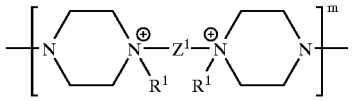

2mA;

(c)

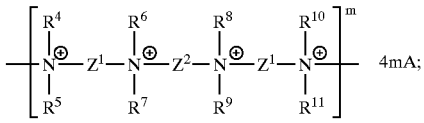

4mA;

(d)

a divalent aromatic or aliphatic heterocyclic group, substituted or unsubstituted, containing at least one quaternized nitrogent atom; and mixtures thereof;

wherein $R^4$, $R^5$, $R^6$, $R^7$, $R^8$, $R^9$, $R^{10}$, $R^{11}$ are the same or different, and are selected from the group consisting of $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof; or in which $R^4$ and $R^6$, or $R^5$ and $R^7$, or $R^8$ and $R^{10}$, or $R^9$ and $R^{11}$ are components of a bridging alkylene group;

m is the number of positive charges associated with the cationic divalent organic moiety, which is greater than or equal to about 2; A is an anion; and $Z^1$ and $Z^2$ are the same or different divalent hydrocarbon groups comprising each at least about 2 carbon atoms.

12. A fabric treatment composition according to claim 1 wherein the nitrogen-free silicone polymer is selected from nonionic nitrogen-free silicone polymers having a formulae selected from (I) to (III):

(I)

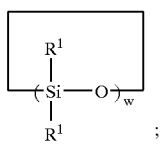

;

$$R^2—(R^1)_2SiO—[(R^1)_2SiO]_a—[(R^1)(R^2)SiO]_b—Si(R^1)_2—R^2 \quad (II);$$

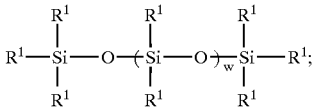

(III)

and mixtures thereof, wherein each $R^1$ is independently selected from the group consisting of linear, branched or cyclic alkyl groups having from about 1 to about 20 carbon atoms; linear, branched or cyclic alkenyl groups having from about 2 to about 20 carbon atoms; aryl groups having from about 6 to about 20 carbon atoms; alkylaryl groups having from about 7 to about 20 carbon atoms; arylalkyl and arylalkenyl groups having from about 7 to about 20 carbon atoms, and mixtures thereof; each $R^2$ is independently selected from the group consisting of linear, branched or cyclic alkyl groups having from about 1 to about 20 carbon atoms; linear, branched or cyclic alkenyl groups having from about 2 to about 20 carbon atoms; aryl groups having from about 6 to about 20 carbon atoms; alkylaryl groups having from about 7 to about 20 carbon atoms; arylalkyl; arylalkenyl groups having from 7 to 20 carbon atoms and from a poly (ethyleneoxide/propyleneoxide) copolymer group having the general formula (IV):

$$-(CH_2)_nO(C_2H_4O)_c(C_3H_6O)_dR^3 \quad \text{(IV)}$$

wherein at least one $R^2$ is a poly(ethyleneoxy/propyleneoxy) copolymer group, and each $R^3$ is independently selected from the group consisting of hydrogen, alkyl groups having about 1 to about 4 carbon atoms, acetyl groups, and mixtures thereof, wherein the index w has the value as such that the viscosity of the nitrogen-free silicone polymer of formulae (I) and (III) is between about $2–10^{-6}$ $m^2/s$ (about 2 centistokes at 20° C.) and about 50 $m^2/s$ (about 50,000,000 centistokes at 20° C.); wherein a is from about 1 to about 50; b is from about 1 to about 50; n is from about 1 to about 50; total c (for all polyalkyleneoxy side groups) has a value of from about 1 to about 100; total d is from 0 to about 14; total c+d has a value of from about 5 to about 150.

13. A fabric treatment composition according claim 1, further comprising one or more laundry adjunct materials selected from the group consisting of:

(a) stabilizers;

(b) surfactants selected from the group consisting of nitrogen-free nonionic surfactants, nitrogen-containing surfactants and anionic surfactants, and mixtures thereof;

(c) coupling agents;

(d) detergent builders;

(e) fabric substantive perfumes;

(f) scavenger agents selected from the group consisting of fixing agents for anionic dyes, complexing agents for anionic surfactants, clay soil control agents, and mixtures thereof;

(g) enzymes;

(h) chelating agents;

(i) solvent systems;

(j) effervescent systems; and (k) mixtures thereof.

14. A method for treating a substrate comprising contacting the substrate with a fabric treatment composition according to claim 1.

15. A process for preparing a fabric treatment composition according to claim 10 comprising the step of a) premixing the nitrogen-free silicone polymer with the cationic silicone polymer; b) premixing all other ingredients; and c) combining said two premixes a) and b).

* * * * *